US008490240B1

(12) United States Patent
Mackesy et al.

(10) Patent No.: US 8,490,240 B1
(45) Date of Patent: Jul. 23, 2013

(54) ATTACHABLE DEBRIS GUIDE FOR WASTE BIN

(76) Inventors: John T. Mackesy, Glendora, CA (US); Michael J. Mackesy, II, Mission Viejo, CA (US); Michael J. Mackesy, Missino Viejo, CA (US)

( * ) Notice: Subject to any disclaimer, the term of this patent is extended or adjusted under 35 U.S.C. 154(b) by 0 days.

(21) Appl. No.: 13/605,001

(22) Filed: Sep. 6, 2012

(51) Int. Cl.
*A47L 13/52* (2006.01)

(52) U.S. Cl.
USPC ..... 15/257.1; 15/257.8; 15/257.9

(58) Field of Classification Search
USPC ..... 15/257.1, 257.3, 257.7, 257.8, 257.9
See application file for complete search history.

(56) References Cited

U.S. PATENT DOCUMENTS

| | | | | |
|---|---|---|---|---|
| 4,550,440 | A * | 10/1985 | Rico | 383/33 |
| 4,802,258 | A * | 2/1989 | Jensen | 15/257.1 |
| 5,547,104 | A | 8/1996 | Parker | |
| D391,726 | S | 3/1998 | Williams et al. | |
| 5,816,591 | A | 10/1998 | Parker et al. | |
| 6,050,442 | A | 4/2000 | Wysocki | |
| D429,398 | S | 8/2000 | Wysocki | |
| 6,974,167 | B2 * | 12/2005 | Springs, II | 294/214 |
| 8,291,543 | B2 * | 10/2012 | McCoy et al. | 15/257.1 |
| 2011/0173769 | A1 * | 7/2011 | Bloom | 15/257.9 |
| 2012/0228314 | A1 * | 9/2012 | Miller | 220/675 |

* cited by examiner

*Primary Examiner* — Randall Chin
(74) *Attorney, Agent, or Firm* — Fulwider Patton LLP

(57) ABSTRACT

An attachable debris guide for a waste bin is disclosed that cooperates with a side of the waste bin to form a pathway into the waste bin. The debris guide is angled so that, when the bin is laid on its side and the debris guide is attached, the debris guide mates with a flat receiving surface such that debris can be swept directly into the waste bin.

6 Claims, 2 Drawing Sheets

FIG. 1
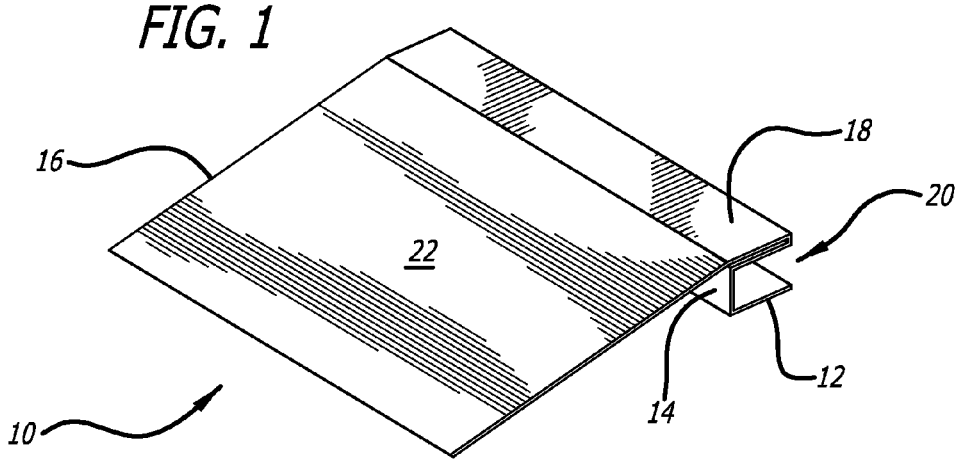
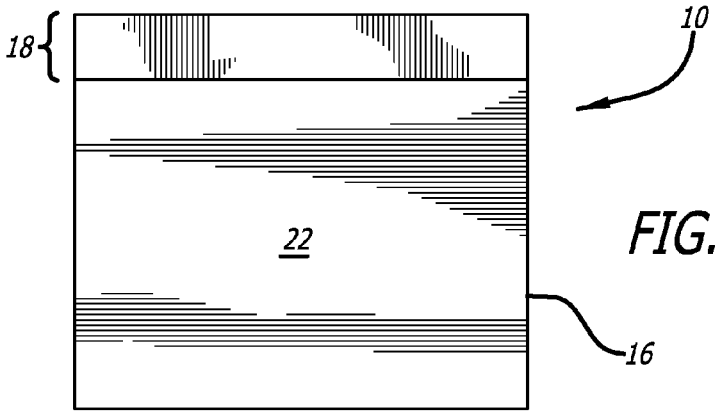
FIG. 2
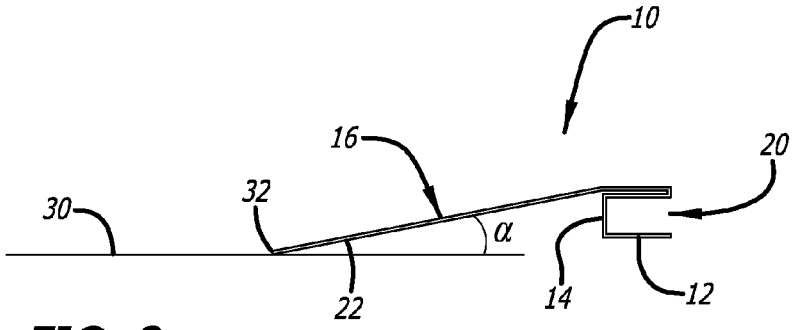
FIG. 3

ATTACHABLE DEBRIS GUIDE FOR WASTE BIN

BACKGROUND

It is common when doing landscaping or yard work to generate a large amount of debris, including grass clippings, leaves, weeds, leaves, branches, and the like. As anyone who has done work of this kind can confirm, there is a number of different steps to remove this debris. Similarly, construction sites and other areas collect nails, wood pieces, paper, saw dust, and other waste. The process of collecting the waste and disposing of it requires that it be first collected in a central location or pile, and then a trash bin must be brought to the collection site. Once a trash bin is brought to the collection site, the waste must be lifted in small amounts using a rake or broom in combination with a dust pan or manually grasping the collection of debris. This act is repeated over and over until the waste is all deposited into the waste bin. This is both labor intensive and time consuming, and adds significant time to the job of cleaning up the waste. Moreover, the act of lifting the waste often is accompanied by contact with the leaves, sharp objects, thorns, metal fasteners, etc. which can include insects, small animals, jagged edges of metal, and other dangers. This leads to cuts, bites, and other injuries to the worker's hands and arms. The repeated lifting of the waste can also put strain on the worker's back and lead to other injuries.

There has been little improvement in the process in the last fifty years, as workers are still performing the same dangerous and labor intensive tasks over and over. What is needed is a simple and reliable tool that can eliminate some of the steps and the injuries that can occur when removing waste and debris.

SUMMARY OF THE INVENTION

An attachable debris guide for a waste bin is disclosed that cooperates with a side of the waste bin to form a pathway into the waste bin. The debris guide is angled so that, when the bin is laid on its side and the debris guide is attached, the debris guide mates with a flat receiving surface such that debris can be swept directly into the waste bin. In this position, a worker can simply rake or sweep the collected debris into the waste bin with no manual contact or lifting of the debris. Using the present invention, the process of collecting and removing the waste and debris can be dramatically shortened with fewer injuries.

BRIEF DESCRIPTION OF THE DRAWINGS

FIG. 1 is an elevated perspective view of a first embodiment of the present invention;

FIG. 2 is a top view of the embodiment of FIG. 1;

FIG. 3 is a side view of the embodiment of FIG. 1;

DETAILED DESCRIPTION OF THE PREFERRED EMBODIMENTS

Figure 4:
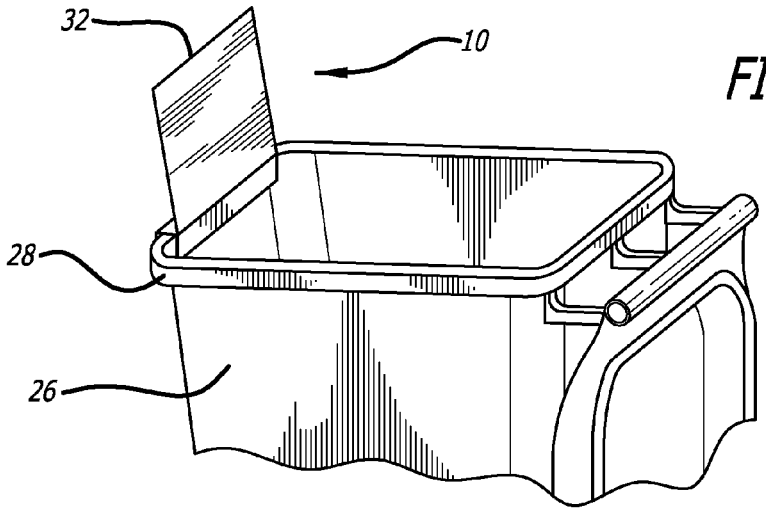
FIG. 4 is an elevated perspective view of the embodiment of FIG. 1 connected to a waste bin.

FIGS. 1-3 illustrate a first preferred embodiment of the present invention, depicting various views of an integral construction from a single sheet of metal such as aluminum. It is to be understood that while this is a preferred embodiment, the device can be fabricated using multiple sheets through welding, fasteners, or the like. The debris guide 10 includes an outside lateral wall 12 and a top wall 14 orthogonal to the side wall 12. A main plate 16 is formed so as to have a first portion 18 parallel to the side wall 12, the first portion 18 cooperating with the top wall 14 and side wall 12 to form a rectangular channel 20. A second portion 22 of the main plate 16 forms a large, angled surface that extends from the channel 20 and forms an angle $\alpha$ with a receiving surface (e.g., the ground). The angle $\alpha$ is preferably between five and thirty degrees, and more preferably between ten and twenty five degrees from a plane defined by the side wall 12.

Figure 5:
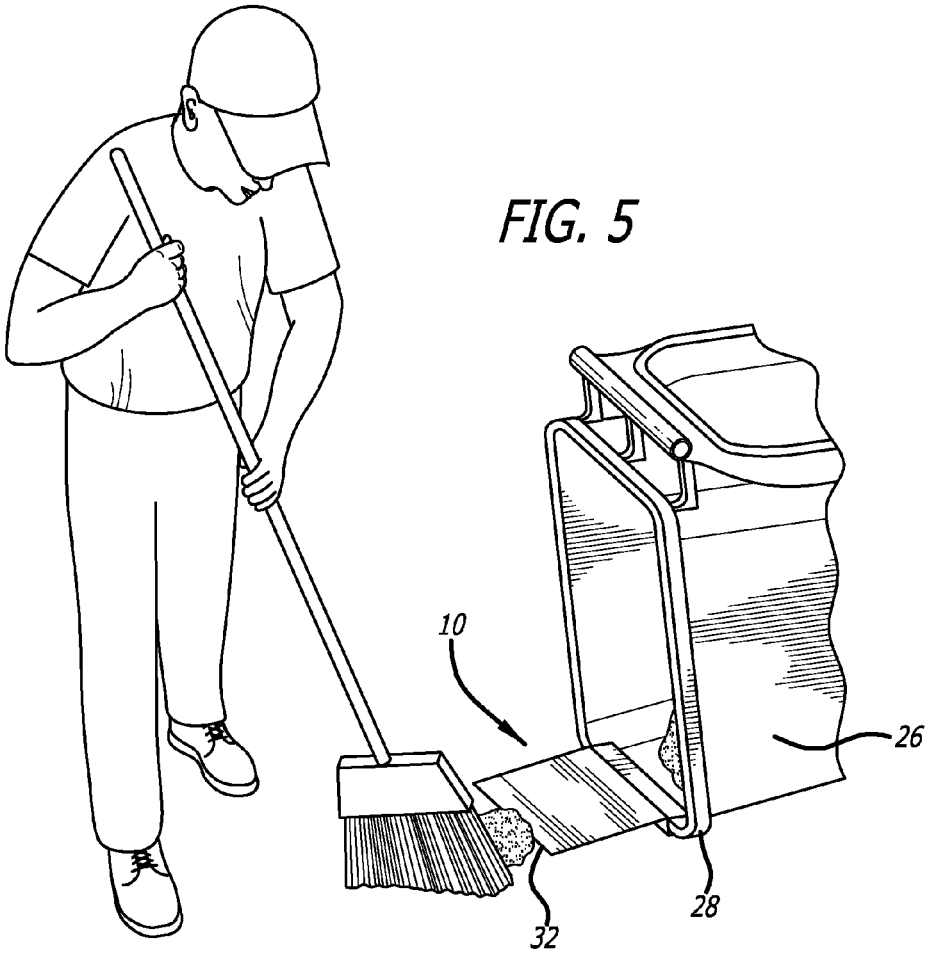
FIG. 5 is an elevated perspective view of the waste bin of FIG. 4 in a horizontal position showing an intended use.

FIGS. 4 and 5 illustrate the debris guide 10 when used with a waste bin 26. The invention is intended to be used with any waste bin that is typically used in such applications, such as those depicted in U. S. patent Nos. D391726, D429398, U.S. Pat. Nos. 5,547,104, 5,816,591, and 6,050,442 as examples. The waste bin 26 includes a side wall with a lip 28 along an upper edge, and the channel 20 of the debris guide 10 is adapted to fit over the lip 28 as shown to connect with the waste bin 26. The debris guide 10 fits over the lip, and then the waste bin 26 is tipped onto its side against a receiving surface 30 such as the ground, such that the debris guide forms a pathway from the ground into the waste bin 26. The angle $\alpha$ between the main plate 16 and the ground is preferably small so that even smaller dirt and waste can be swept onto the debris guide and into the waste bin 26 instead of being driven beneath the debris guide 10.

In operation, when performing clean-up in a landscaping or other application where debris has collected on the ground and needs to be transferred to a waste bin, a user will take the debris guide 10 of the present invention and place it over the lip of the waste bin so that the lip occupies the channel 20 in a secure manner. The waste bin is then rocked onto its side so that the debris guide 10 touches the ground at the front edge 32.

We claim:

1. A removable debris guide for temporary coupling with a waste bin, comprising:

a first thin plate forming an outside lateral side wall, the first thin plate being flat to align with a flat receiving surface;

a second thin plate directly connected to the first thin plate in an orthogonal relationship;

a third thin plate orthogonal to the second thin plate and cooperating with the first and second thin plates to form a C shaped channel adapted to receive an upper lip of a waste bin, the third thin plate having a length that is approximately equal to the first plate;

a main plate having a first portion and a second portion, the first portion covering the third plate and parallel to the first and third plates, a length of the first portion approximately equal to the first plate, and a second portion comprising a surface angled from a top of said channel linearly to the flat surface, where a length of the second portion is greater than a length of said first portion and a height of the second portion is greater than a height of the C shaped channel.

2. The removable debris guide of claim 1, wherein the surface forms an angle with the receiving surface of between ten and twenty-five degrees.

3. The removable debris guide of claim 1, wherein the first thin plate, second thin plate, third plate, and main plate are formed of sheet metal.

4. The removable debris guide of claim 1, wherein a length of the second portion of the main plate is approximately twice as long as a length of the first portion.

5. The removable debris guide of claim 1, wherein the first thin plate, second thin plate, third plate, and main plate are integrally formed from a single sheet.

6. The removable debris guide of claim 1, wherein the main plate is approximately fifteen inches in length.

* * * * *